United States Patent [19]

Gionet et al.

[11] Patent Number: 4,577,437

[45] Date of Patent: Mar. 25, 1986

[54] AUTOMATIC DOOR OBJECT SENSING SYSTEM

[75] Inventors: Daniel C. Gionet; Harry V. Nguyen, both of St. Petersburg, Fla.

[73] Assignee: Lanson Electronics, Inc., Pinellas Park, Fla.

[21] Appl. No.: 675,004

[22] Filed: Nov. 26, 1984

[51] Int. Cl.[4] ..... E05F 15/20

[52] U.S. Cl. ..... 49/25; 49/26; 318/480

[58] Field of Search ..... 49/26, 28, 25; 318/480

[56] References Cited

U.S. PATENT DOCUMENTS

| | | | |
|---|---|---|---|
| 2,138,521 | 11/1938 | Ellis | 49/28 |
| 4,009,476 | 2/1977 | Lutz | 49/25 X |
| 4,029,176 | 6/1977 | Mills | 49/25 X |
| 4,272,921 | 6/1981 | Jorgensen | 49/25 X |
| 4,458,446 | 7/1984 | Mochida et al. | 49/28 |
| 4,467,251 | 8/1984 | Jönsson | 318/480 |

*Primary Examiner*—Philip C. Kannan

*Attorney, Agent, or Firm*—Walter J. Monacelli

[57] ABSTRACT

Mechanism for automatic swing doors including three motion detectors, two associated with the approach side of the door and one on the swing side of the door, with the detectors on the approach side effective, when activated, to open the door and the detector on the swing side effective, when activated, to slow down the moving door.

14 Claims, 7 Drawing Figures

FIG. 1
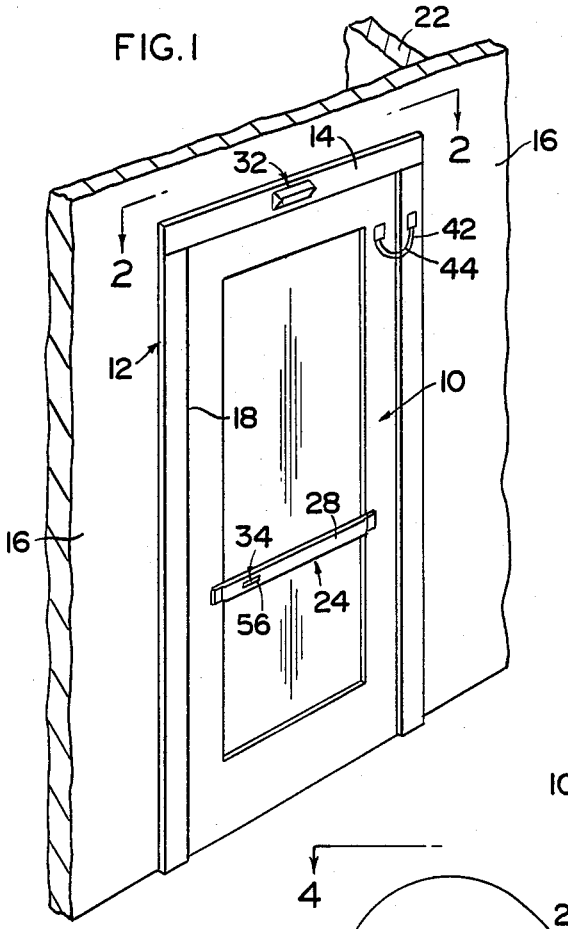
FIG. 2
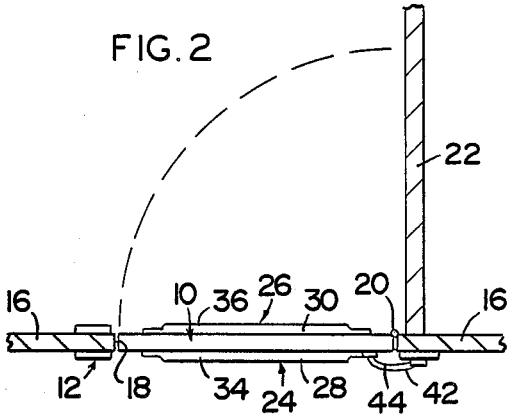
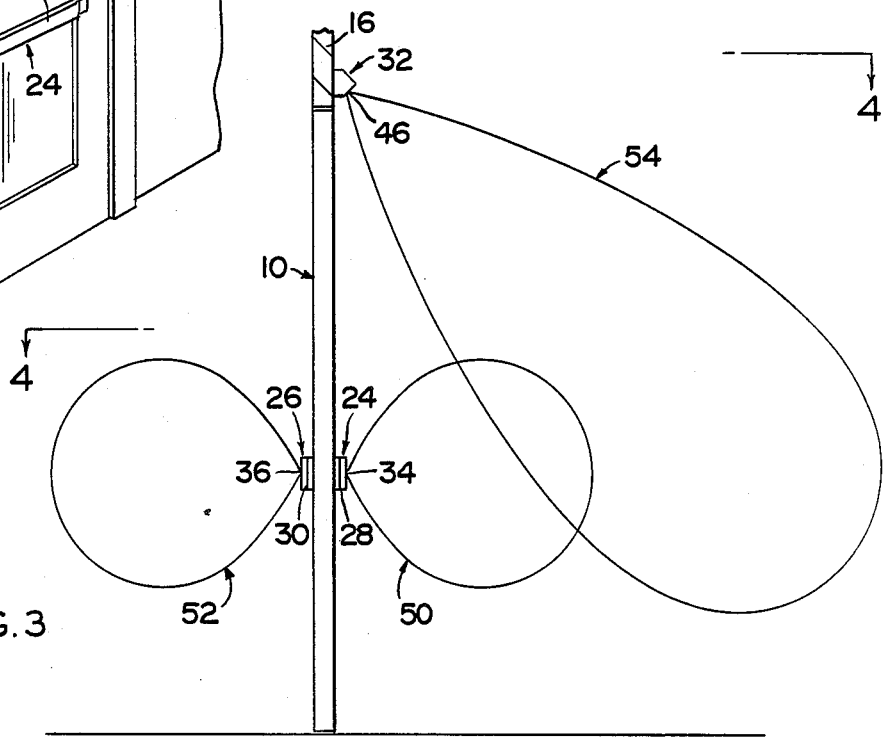
FIG. 3
FIG. 4
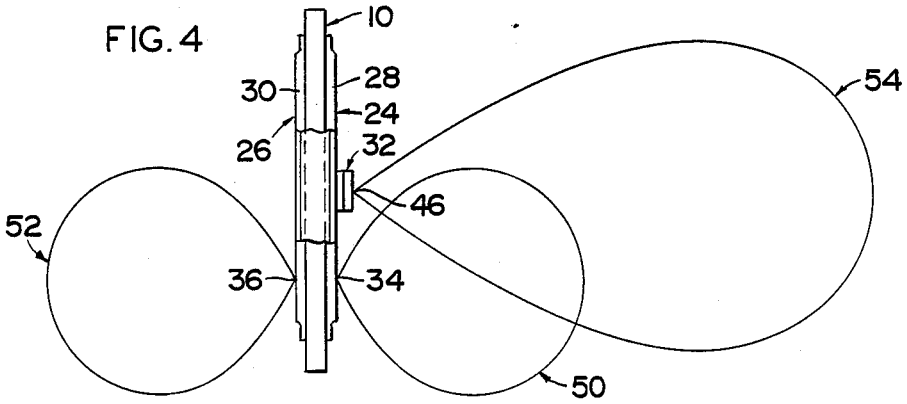

AUTOMATIC DOOR OBJECT SENSING SYSTEM

BACKGROUND OF THE INVENTION

1. Field of the Invention

The invention relates to object sensing apparatus and more particularly to the utilization thereof in automatic swing door mechanisms.

2. State of the Prior Art

Although automatic swing door mechanisms are well known and in extensive use, the patent art relative thereto is rather limited. U.S. Pat. Nos. 1,929,273, 3,852,592 and 4,467,251 appear to represent the best art having a bearing on the present invention, but only U.S. Pat. No. 4,467,251 incorporates means relating to safety in connection with the swing side of the automatic door structure. The present invention, while directed to a similar basic idea, incorporates distinct variations in the type of structure employed and the comparative mode of operation thereof. Particularly, this invention employs the well known and used microwave beam principle as the primary means of object detection, together with controlled circuitry for easily and effectively achieving most desirable results.

SUMMARY OF THE INVENTION

The automatic swing door system covered hereby is primarily concerned with the prevention of injury to persons or damage to inanimate objects on the swing side of the door in which the system is incorporated.

The system of this invention employs a conventional microwave beam motion detector for swinging open the door when a person enters the beam from the approach side of the door. As is the normal arrangement, the microwave motion detector is mounted on the header above the door and upon detecting a person or object approaching the door energizes a circuit in which it is arranged to operate appropriate motor means for actuating or swinging the door away from closed to open position. As the object continues its movement toward and through the doorway, a microwave motion detector mounted on the approach side of the door has its beam interrupted by the object. The beam from the microwave detector over the door is designed to have a wide beam projecting out several feet from the door and reasonably close to the floor, whereas the microwave detector on the approach side of the door has a shorter and narrower beam.

In the normal opening of the door as effected by the microwave detector above the door and since the microwave detector on the door and the one above the door are in parallel in the circuit to the motor, the door will move quickly to full open position. It is to be appreciated that the operation occurs if no person or object is positioned on the swing side of the door in the path of the door. Should a person or object be moving into or be positioned on the swing side of the door or path thereof, a microwave beam from a microwave motion detector mounted on the swing side of the door will be interrupted and operate through circuitry integrated with the circuitry for the door operating motor to slow down the movement of the door from its normal faster cycle to a much slower one. In this way the person or object can move or be moved out of the path without injury of damage as might otherwise occur if the door were not so controlled. At this point in the operation of the door, even if the object or person moves out of the path, a purposeful time delay is incorporated in the circuit ample to be sure the interference is removed. Even with the continued movement of the person or object from the approach side of the door, the door will move slowly to full open position. While it is understandable that a force of say five pounds can impede or stop movement of the door, it is presumed that a person or object on the swing side of the door will exit the swing side door path.

By the appropriate tuning of the respective beams emanating from the microwave motion detectors above the door and on opposite sides of the door, they can effectively perform their intended functions without being activated by the door frames, floor, wall or other structures in connection with which the door and doorway are disposed.

So that the beam provided by the microwave motion detector on the swing side of the door does not effect the operation of the door once it has attained its full open position adjacent the wall and begins its return to closed position, it is unidirectional in operation and is only effective when the beam moves toward an object or person or vice versa. As such, the motion for operating the door and particularly the return spring therefor can move the door without pauses or jerks, that is, a slowing down thereof, if, in fact, an object or person interrupted the beam when the door moves to closed position.

Whereas the circuitry for the motion detector on the swing side of the door has a built-in three second residual for continued operation even after the person or object is moved from its beam path, the circuitry for the motion detectors on the approach side of the door and the overhead of the door have a one second residual built therein. This second residual allows these circuits to operate even if the object or person approaching the door stops in the course of its travel toward the door.

As an alternative to the use of a short and narrow beam on the swing side of the door it could be modified by the use of a microwave motion detector that initially sends out a wider and longer beam and one which can be changed or controlled to a short and narrow beam once the door has moved approximately ten degrees. In this way, as the door begins to swing open it will be able to pick up a person disposed at a point futher from the swinging door than in the case of the shorter and narrower beam.

The three microwave detectors employed in the present invention are sometimes referred to as sensors or transceivers but shall herein for the sake of continuity be referred to as detectors.

An object of the invention is the provision of a system for controlling the automatic operation of swing doors that protects against object or person intrusion on the swing side of the door.

Another object of the invention is the provision of simple and effective means for controlling the operation of an automatic actuated swing door, capable of preventing injury to a person in the path of the door on the swing side thereof.

A further object of the invention is the provision of a control system, for automatically operating swing doors wherein relative motion of the door or a person toward the door is effective to cause the desired slowing down of the door in its opening operation once the door is placed in motion by a person approaching the door from the approach side thereof.

A yet further object of the invention is the provision of three microwave motion detectors, a principal one mounted above a door way on the approach side thereof adapted upon energization to operate a motor for opening a swing door, a second detector mounted on the approach side of the door operable to operate the motor in a continued manner simultaneously with or after the first detector and a third detector mounted on the swing side of the door effective to slow down the opening movement of the swing door upon the energization thereof. BRIEF DESCRIPTION OF THE DRAWINGS FIG. 1 is a fragmentary perspective view of a door arrangement embodying the invention;

FIG. 2 is a top plan view taken along lines 2—2 of FIG. 1;

FIG. 3 is a side view of the door of FIG. 1 schematically illustrating microwave beam patterns of the motion detectors used;

FIG. 4 is a top plan view taken along lines 4—4 of FIG. 3.

DESCRIPTION OF THE PREFERRED EMBODIMENT

Figure 5:
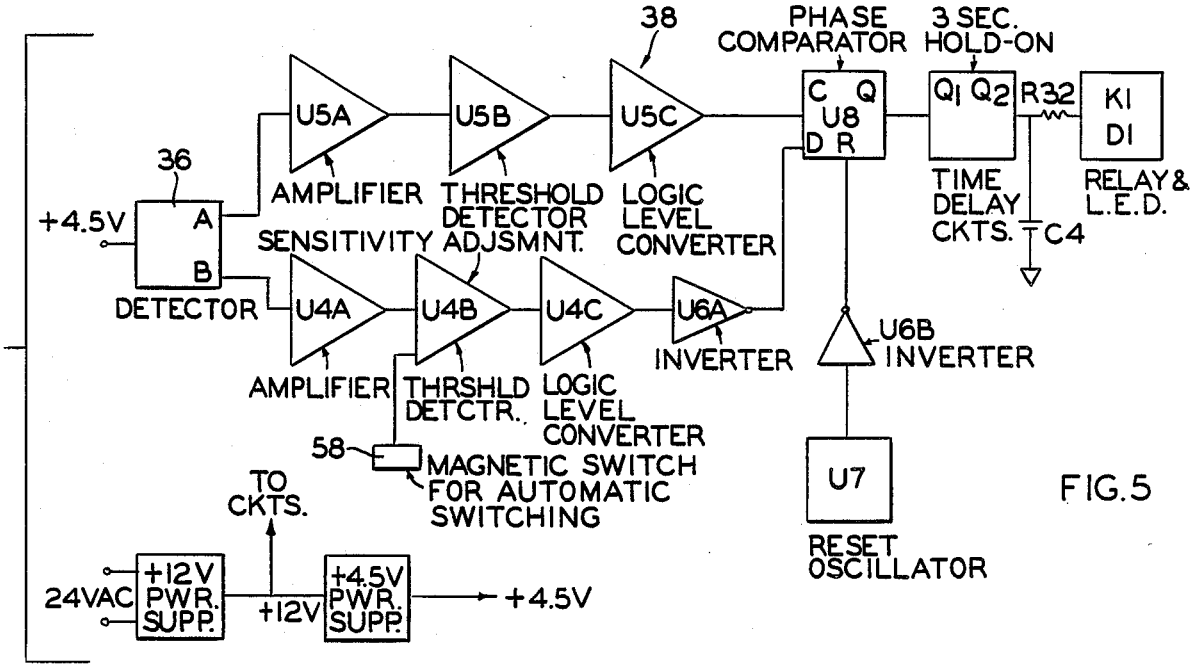
FIG. 5 is a block diagram of the circuitry for the swing side of the door microwave motion detector.

FIG. 1 is a perspective view of an automatic opening door 10 in connection with which the present invention of a motion sensing and control system is employed for the safe and effective swing opening of the door. The door is conventionally arranged by the hanging thereof in a suitable door frame 12 having a door header 14 secured upon a wall 16 having a passageway 18 therethrough. The door is hinged at 20 and is swingable as shown in FIG. 2 toward a wall 22 attached to wall 18 and extending perpendicular thereto.

Motion detector assemblies 24 and 26 are mounted on opposite sides of the door and each includes an oblong housing 28 and 30 respectively extending horizontally across the respective approach and swing sides of the door. Another motion detector assembly 32 is securely mounted over the door on header 14 on the approach side of the door.

Figure 7:
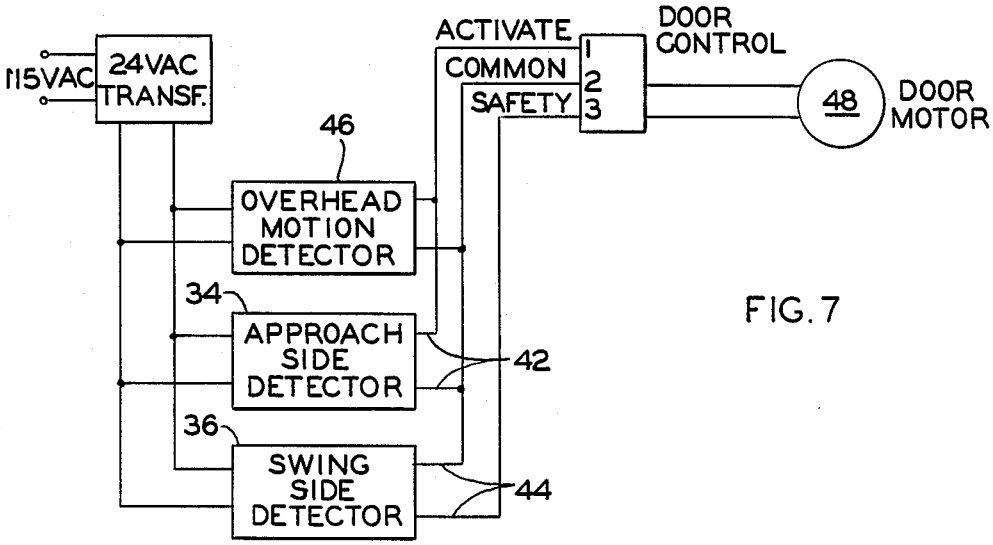
FIG. 7 is a block diagram of the integrated circuits for the door operating system.

Each of the housings 28 and 30 respectively includes therein microwave detectors 34 and 36 and respective appropriate circuitry in the form of circuits 38 and 40. The output leads 42 and 44 of these circuits bridge from the door 10 to frame 12 as shown in FIG. 1 for connection to a conventional automatic swing door operating mechanism shown in block diagram in FIG. 7. Motion detector assembly 32 includes a detector 46 of the conventional microwave motion detecting type used in supermarkets and the like automatic door operating and includes circuitry similar to circuit 38 and together with the output of motion detectors 34 and 36 as shown in FIG. 7 controls the operation of the door motor 48.

The mechanism of the type employed with door overhead motion detector 46 is conventionally known and includes means for modifying the speed of movement of a door as it approaches full open position adjacent a wall or as it moves to full closed position. The speed of the door is slowed in each instance at opposite ends of its motion so as to eliminate any banging or slamming of the door.

FIGS. 3 and 4 disclose what might be considered appropriate microwave beams cast by the microwave motion detectors with beams 50 and 52 respectively of microwave motion detectors 34 and 36 and beam 54 projected by microwave motion detector 46. It will be noted that beam 54 is longer and wider than beams 50 and 52 and as such intercepts any object or person approaching same at a much further distance from door 10 than is the case with beam 52, the purpose of which will hereinafter appear. Also it is to be noted by the way beam 54 is projected that it covers a wide vertical path with a portion close to the floor and this would be in the path of a small object or child.

Beams 50 and 52 it will be noted emanate from their respective detectors at a point closer to the opening edge of door 10, the purpose of which will hereinafter appear.

Each of the detectors 34, 36 and 46 are arranged in their respective housing behind a plastic or the like cover 56 shown in connection with detector 34 in FIG. 1.

Circuit 38 operates from a 24 volt A.C. current with a 52 volt varistor across the input power terminals to clip any incoming transients. A full wave bridge rectifies the A.C. to D.C. which then is applied to a 12 volt regulator through a dropping resistor with the output of the regulator operating all the logic circuits and amplifiers. Likewise the 12 volt regulator output is fed to a 4.5 volt regulator whose output is used to operate detector 36.

Detector 36 is provided with two diodes having outputs A and B which are fed to two identical amplifier circuits U4 and U5, with the signal from A connected to the clock input of flip/flop U8 and the B signal is connected to the data input. The function of the flip/flop is to perform a phase discrimination to sense only movement toward the detector 36. A clock oscillator U7 is continuously resetting the flip/flop in order to perform the phase sensing. Each of the outputs or channels A and B has a sensitivity adjustment, with channel A adjustment made at the factory and that for channel B accessible for on-site sensitivity adjustment. U4A and U5A are the amplifier stages and U4C and U5C are crossing detectors used to convert the analog signal to logic compatible levels.

When a target, such as an object or person, is detected moving towards detector 36 or the door is moving toward a target, pulses will exit Q output of U8. These pulses will then turn on darlington state Q1 and Q2 to pick the relay and turn on LED (light emitting diode) D1. A time delay is accomplished by the charging of C4 which then can only discharge through R32 and the base of Q. This time delay is approximately 3 seconds and allows the sensing circuits to operate more smoothly by holding the relay energized after movement stops. The LED is used by the installing technician to verify proper operation and to assist in setting the proper desired sensitivity.

Figure 6:
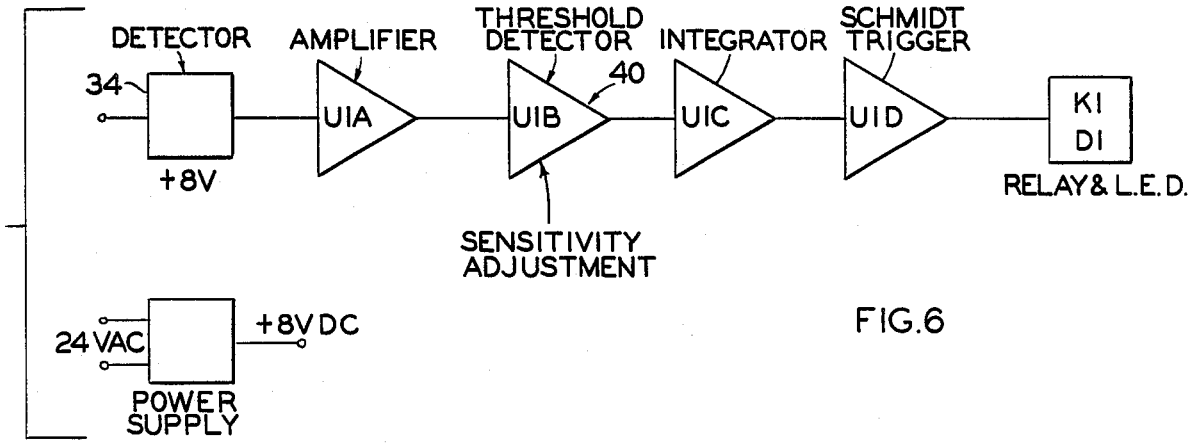
FIG. 6 is a block diagram of the circuitry for the approach side of the door microwave motion detector.

The circuit 40 shown in FIG. 6 is for the detector 34 mounted on the approach side of the door and is basically one channel as compared to the two channel system of circuit 38 employed with swing side detector 36. As such, detector 36 uses only one detector diode which is used to sense motion.

The circuit 40 for detector 34 and circuit, not shown, for detector 46 are alike and each use 8 volts in comparison to 4.5 volts for circuit 38. As noted in FIG. 6, each circuit has an integrator time delay U1C and Schmidt trigger U1D which perform the needed trimming and switching functions. The contacts of the relay are connected to the activate control lines of the door and the LED is used to aid in adjusting the sensitivity. Sensitivity adjustment U1B is provided for adjusting the range of the beams 50 and 54 as relates to each separate circuit for detectors 34 and 46. These circuits are each arranged to have a time delay of approximately one second to bridge gaps in movement of an object when in the beam's range.

Whereas detector 34 is effective to sense motion in either direction, that is movement toward or away therefrom, detector 36 is purposely programmed to detect or sense movement toward it, the purpose of which will hereinafter appear.

In situations where it may be desirable to have the swing side detector switch from a high sensitivity to lower setting as soon as the door begins to move, that is wherein a much wider and longer beam than beam 52 is used, a magnetic switch 58 as seen in FIG. 5 is adapted to be mounted at the end of housing 30 for interaction with a magnet, not shown, on the door frame. Through the use of such a switch, once the door begins to move the magnetic switch will cause a relay to drop out and thus change the sensitivity of the beam to a smaller one such as beam 52. This mode of operation would be essential with extra-wide doors in order to pick up anyone standing at or near the hinge end of the door. The sensitivity adjustment sets the maximum, and the automatic change system reduces to approximately half.

OPERATION OF THE AUTOMATIC SWING DOOR

In the normal operation of door 10 a person or object approaching the door from the approach side thereof is detected by motion detector 46 and through its circuit arrangement operates motor 48 which in turn moves the door in an opening operation. As the person proceeds through the door the beam 50 of motion detector 34 is interrupted and acts in parallel with the circuit of detector 34 and beam 54 to permit the door to open fully. If the person should move to a point in the door swing path and remain there, the door as driven by a return spring incorporated with door motor and controls therefor will begin to close. As soon as it begins to move to closed position, the motion of the door toward the person will, through beam 50, reactivate the motor to reopen it. This sequence will repeat as long as the person remains there. Once the person either backs away from the door or passes through, the door will move quickly to closed position by the return spring.

Presuming that in accordance with the preceding paragraph a person approaches the door to pass through the doorway but a person or object is located on the swing side of the door. In this situation, immediately as the door begins to open and the person or object is in the range of beam 52 of motion detector 36 on the swing side of the door, the door will open but in a very slow mode as dictated by the interruption of beam 36 and energization of circuit 38 to slow the motor down and thus the movement of the door. As long as the obstruction in the swing side path of the door remains the door will continue to open slowly. At this point the obstruction will have ample time to move out of the door's swing path without injury or damage. If a person should move into the swing zone behing the door while the door is closing, the closing motion of the door will not be effected since circuit 38 is unidirectional and is only operational when the door is moving toward the person and not away from the person. Accordingly the door will close at its normal faster speed.

It should be kept in mind that circuit 38 has a three second delay therein so that as the door is slowed down in its opening operation ample time lapse is provided so that the person or object can have ample time to move out of the door's opening swing path. Further operational time delays of one second are provided in the circuits for detectors 34 and 46 so as to account for stoppages or pauses in movement to and through the doorway and permit smooth movement of the door in its opening phase.

Since the opening of the door is not stopped even though its detector 36 senses an obstruction, likewise the door will not be stopped by reason of the beam 52 being interrupted by wall 22 as the door opens to its full open position. The extent of door opening is controlled by structure incorporated therein, conventionally of the type used in automatic door operators. Normally this structure provides for the slowing and stopping of the door at its extreme points of operation, that is full closed and full open.

It is to be noted that whereas beam 54 of detector 46 covers a long and wide path to intercept a person say five feet from, beam 50 of detector 34 and beam 52 of detector, are arranged closer to the opening edge of the door and are much smaller in width and length. These beams are expected to work at closer range to the person intercepted thereby and also so as not to pick up door frames, etc. in the movement of the beam with the door.

Recognizing that the system employed herein relative to the operation of detectors 34, 36 and 46 might very well be used on wider doors it is suggested that a wider, larger beam be projected from detector 36 which would be projected in a path reaching closer to the hinge side of the door and be able to intercept a person in that zone. Since such a beam would be detrimental to the door's normal opening operation if it were continued after the door opened, a switch 58 is employed effective immediately to reduce the beam to the size of beam 52.

It is to be appreciated that while the description is specific to the disclosure presented, variations in structure are conceivable within the scope of the aforesaid description and accordingly, the appended claims are intended to define same.

What we claim is:

1. An automatic swing door structure comprising a door, adapted to be mounted in the doorway of a support structure for swing opening relative thereto, a motion detector fixedly mounted for projecting a motion detecting beam over a path within the door width and a few feet forward of the door on the approach side thereof, a motion detector fixedly mounted on the approach side of the door for projecting a motion detecting beam over a narrower and shorter path, forward of the approach side of the door, than the first beam, a motion detector fixedly mounted on the swing side of the door for projecting a motion directing beam over a path in size similar to the second beam, outwardly of the swing side of the door, and motor means operated by the motion detecting means when the beams are intercepted by an object.

2. An automatic swing door structure according to claim 1, wherein an object moving into the first beam causes actuation of the motor means to swing open the door and wherein the continued movement of the object toward the door intercepts the second beam which causes the continued operation of the door being opened.

3. An automatic swing door structure according to claim 2, wherein if an object is in the swing path of the door as it opens the movement of the door and the interruption of the third beam causes the motor means to slow down the movement of the door.

4. An automatic swing door structure according to claim 3, wherein the first motion detector is mounted at a point over the door with its beam being projected toward the floor but terminating a short distance from the floor.

5. An automatic swing door structure according to claim 4, wherein each of the motion detectors is of the microwave type.

6. Control mechanism for an automatic swing door having motor means for moving said door from closed to open position and the reverse thereof comprising, a first motion detector mounted above the door on the approach side thereof, a second motion detector mounted on the approach side of the door, a third motion detector mounted on the swing side of the door, the first detector emitting a beam extending downwardly and outwardly away from the door on the approach side thereof, and each of the second and third detectors emitting a beam in a direction extending away from the side of the door from which it emanates, and a control circuit for activating the motor means to open the door in response to the output from the first detector, the control being also responsive to the output from the second detector such that the door is further activated by the motor means, and the control being responsive to the third detector to slow down the opening motion of the door.

7. Control mechanism for an automatic swing door according to claim 6, wherein the control circuit includes in the third detector portion thereof means for sustaining the slowing down of the door even if the object intercepting the beam moves out of the beam's path.

8. Control mechanism for an automatic swing door according to claim 6, wherein an object is detected by the first detector, the output of the detector is fed to the control circuit which activates the motor means to open the door, further when the object is detected by the second detector, the output thereof is fed to the control circuit to continue the door opening and if during any phase of the door opening an object is in the path of the beam of the third detector the movement of the door will be slowed down as the output of the third detector is fed to the control circuit.

9. Control mechanism for an automatic swing door having motor means for swinging the door open in a first direction from a closed position in response to the approach of an object and for slowing down the operation of the motor means in response to the presence of an object on the swing side of the door comprising a first object detector mounted above the door on the approach side of the door, a second object detector mounted on the approach side of the door, a third detector mounted on the swing side of the door, the detectors each emitting beams capable of detecting objects in the range thereof and each effective to provide an output signal indicating the presence of an object, and control circuit means coupling the output of the detectors to the motor means, the motor means being activated to open the door in response to the output signal from the first detector, the motor means also being activated to open the door in response to the output from the second detector, and the motor being activated to slow down the opening of the door in response to the output from the third detector.

10. Control mechanism according to claim 9, wherein the beam emitted from the first detector covers a relatively long and wide path, and wherein the beams emitted by the second and third detectors are considerably shorter and narrower than the beam of the first detector.

11. Control mechanism according to claim 10, wherein the beam from the first detector extends in a path downward and outward on the approach side of the door, wherein the beam from the second detector extends in a path away from the door on the approach side thereof and is smaller in range than the beam from the first detector, and wherein the beam from the third detector extends in a path away from the swing side of the door.

12. Control mechanism according to claim 11, wherein the beam from the third detector is larger in range than the beam of the second detector.

13. Control mechanism according to claim 12, wherein a switch means is provided in the control circuit means for the third detector effective to reduce the range of the beam of the third detector once the door begins to open.

14. Control means according to claim 13, wherein each of the detectors is of the microwave type.

* * * * *